US009345313B2

(12) United States Patent
Merzon

(10) Patent No.: US 9,345,313 B2
(45) Date of Patent: May 24, 2016

(54) HOLSTER FOR HANDHELD DEVICE

(71) Applicant: Richard H. Merzon, Far Hills, NJ (US)

(72) Inventor: Richard H. Merzon, Far Hills, NJ (US)

( * ) Notice: Subject to any disclaimer, the term of this patent is extended or adjusted under 35 U.S.C. 154(b) by 0 days.

(21) Appl. No.: 14/197,276

(22) Filed: Mar. 5, 2014

(65) Prior Publication Data

US 2015/0245700 A1 Sep. 3, 2015

Related U.S. Application Data

(60) Provisional application No. 61/775,385, filed on Mar. 8, 2013.

(51) Int. Cl.
*A45F 5/02* (2006.01)

(52) U.S. Cl.
CPC ..... *A45F 5/021* (2013.01); *A45F 2200/0516* (2013.01)

(58) Field of Classification Search
CPC ..... A45F 5/021; A45F 2200/0525; A45F 2200/0516; A45F 2200/0508
USPC ..... 224/196, 245, 247, 660, 676, 678, 929, 224/930
See application file for complete search history.

(56) References Cited

U.S. PATENT DOCUMENTS

| | | | | |
|---|---|---|---|---|
| 4,534,063 | A * | 8/1985 | Krumin | G08B 5/224 224/163 |
| 5,097,997 | A * | 3/1992 | Kipnis | A44B 99/00 224/195 |
| 8,490,937 | B2 * | 7/2013 | Crain | F16M 13/02 224/929 |
| 8,616,422 | B2 * | 12/2013 | Adelman | A45F 5/00 224/191 |
| 8,915,361 | B2 * | 12/2014 | Rayner | G06F 1/1601 206/320 |
| 9,027,814 | B2 * | 5/2015 | Tages | A45F 5/021 224/666 |
| 2008/0110946 | A1 * | 5/2008 | Dixon | A45F 5/02 224/197 |

* cited by examiner

*Primary Examiner* — Gary Elkins
(74) *Attorney, Agent, or Firm* — R. Tracy Crump

(57) ABSTRACT

The holster securely locks the handheld device, such as a radio within the holster body and allows the radio or device to be readily inserted or removed with a single hand. The holster has a resilient polymer body molded to have an integral pair of retention ears, which hinge to securely lock the device in place and a projection member, which applies an outward force on the device to urge it outward from the holster when the retention ears are manually disengaged.

6 Claims, 12 Drawing Sheets

HOLSTER FOR HANDHELD DEVICE

This application claims priority from co-pending U.S. Provisional Patent Application Ser. No. 61/775,385 filed on Mar. 8, 2013, entitled "Holster for Handheld Device" which is hereby incorporated by reference.

This invention relates to a holster for carrying hand held devices, such as radio, GPS and phones, and in particular a holster for carrying a police radio, which can be holstered and un-holstered using a single hand.

BACKGROUND AND SUMMARY OF THE INVENTION

Handheld electronic devices, such as cell phones, radios and GPS devices are often carried in clothing pockets or carrying pouches worn by users. Law enforcement personal, in particular, frequently carry their police radios in pouches attached to their utility belts. Conventional radio pouches allow radios to be securely carried, but do not allow the radios to be conveniently accessed or accessed with a single hand.

The holster of this invention provides a holster that not only securely locks a handheld device, such as a radio or other electronic device, within the holster body, but allows the radio or device to be readily inserted or removed with a single hand. The holster has a resilient polymer body molded to have an integral pair of retention ears, which hinge to securely lock the device in place and a projection member, which applies an outward force on the radio to urge it outward from the holster when the retention ears are manually disengaged. The retention ears each have a rib that extends inward and seats within a groove from the corners of the device to securely hold it within the holsters. Each of the retention ears also have a lever arm that when depressed allows the ears to spread and unseat the ribs from the grooves releasing the device from the holster. The projection member applies a small outward force on the device within the holster to urge the radio outward once released allowing the device to be conveniently grasped and withdrawn from the holster.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
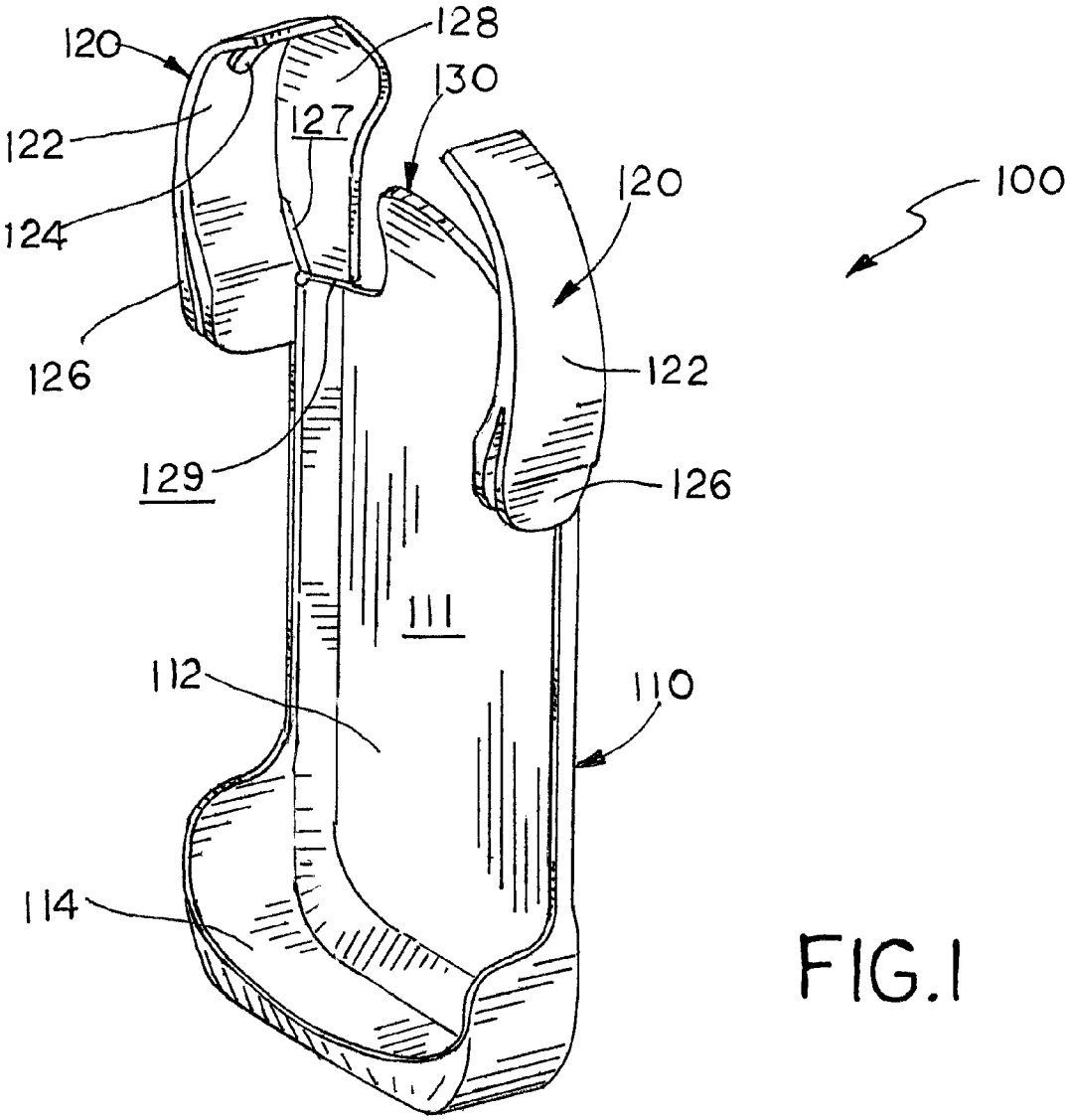
FIG. 1 is a front perspective view of an embodiment of the holster of this invention.
Figure 2:
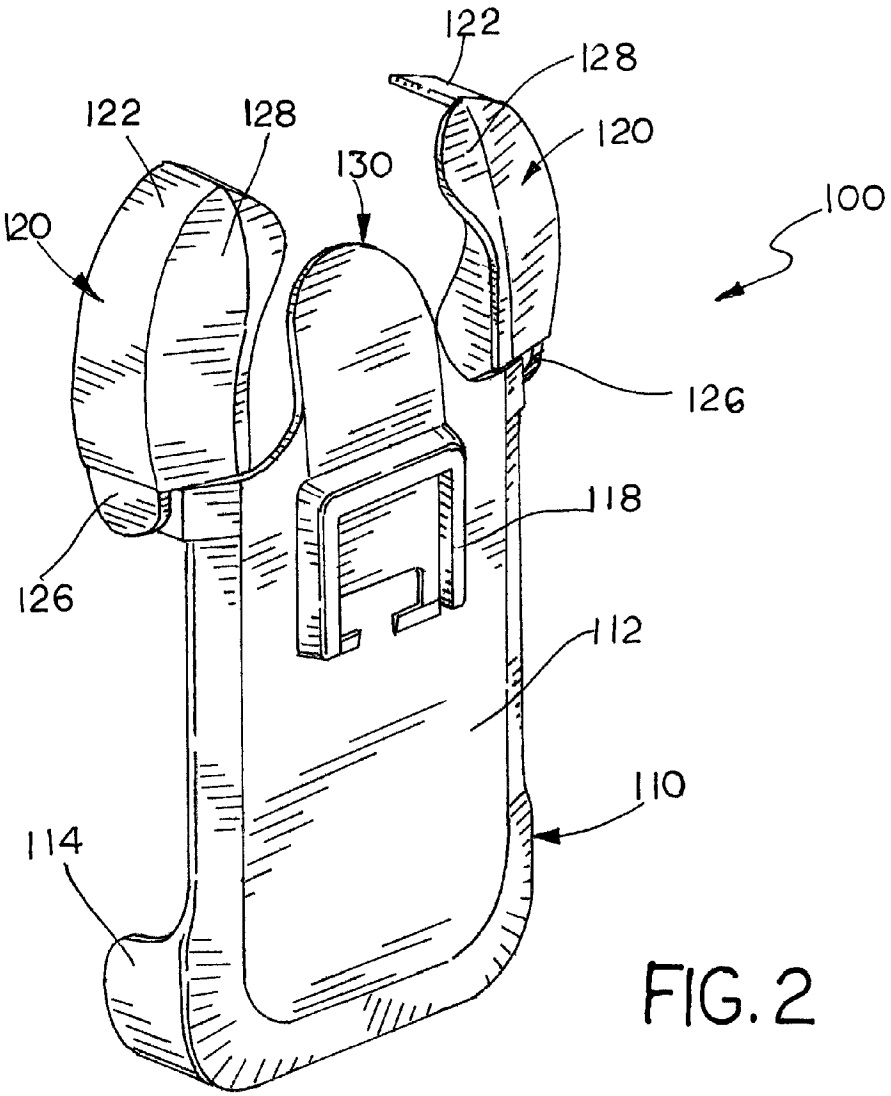
FIG. 2 is a rear perspective view of the holster of FIG. 1.
Figure 3:
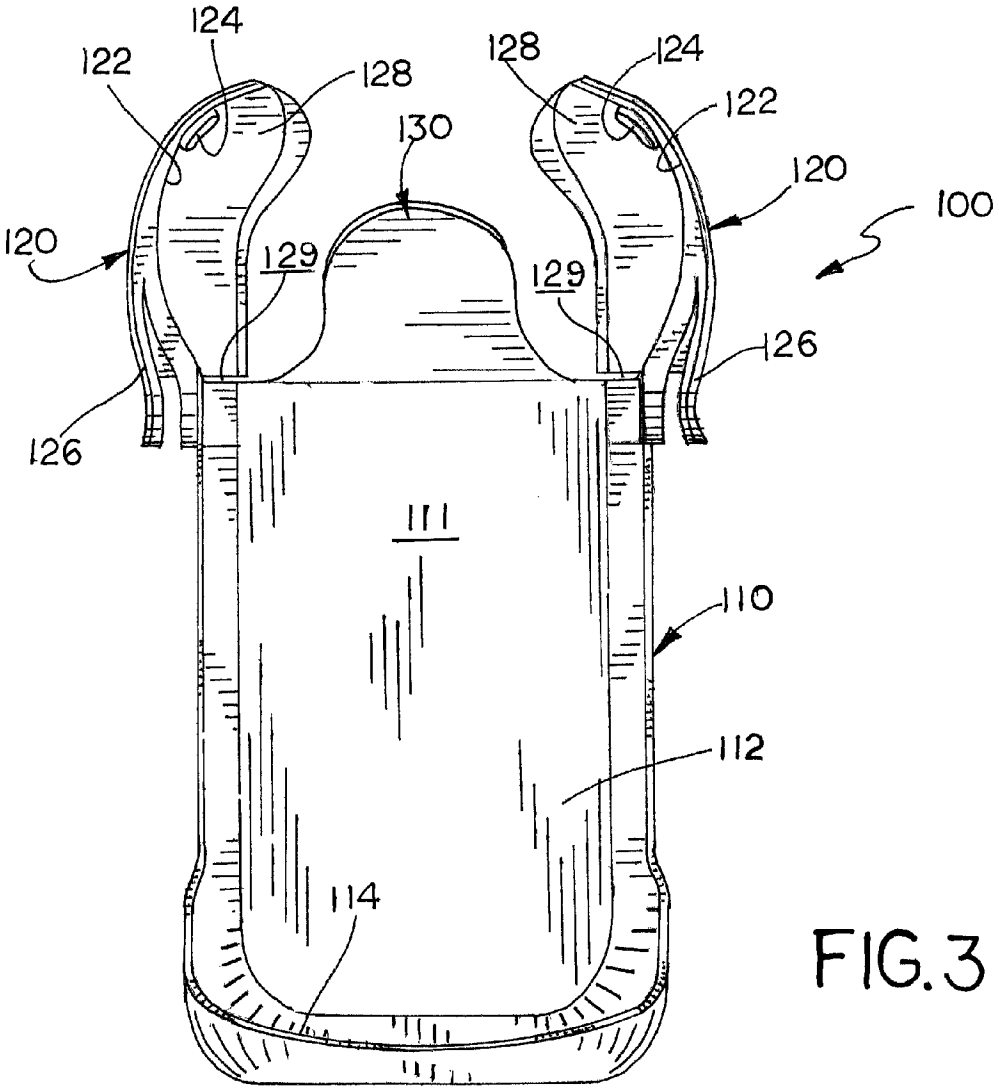
FIG. 3 is a front view of the holster of FIG. 1.
Figure 4:
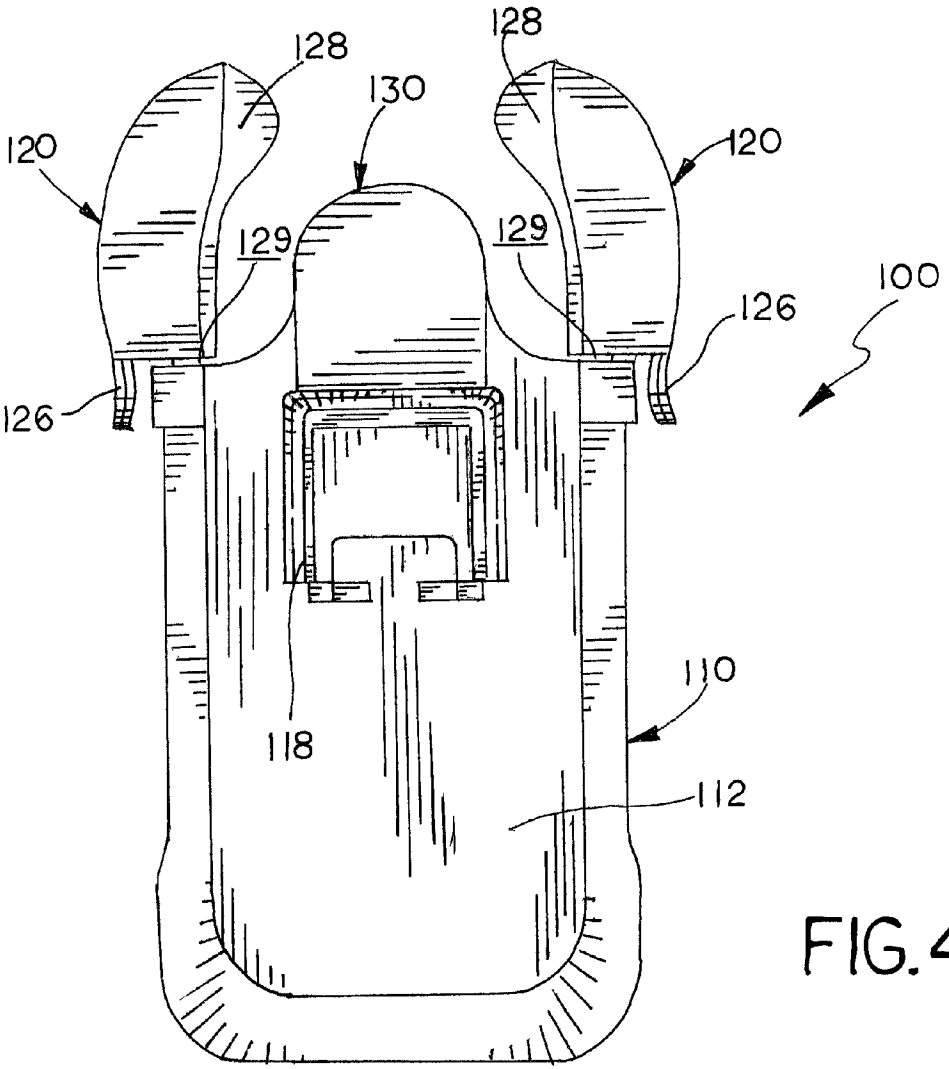
FIG. 4 is a rear view of the holster of FIG. 1.
Figure 5:
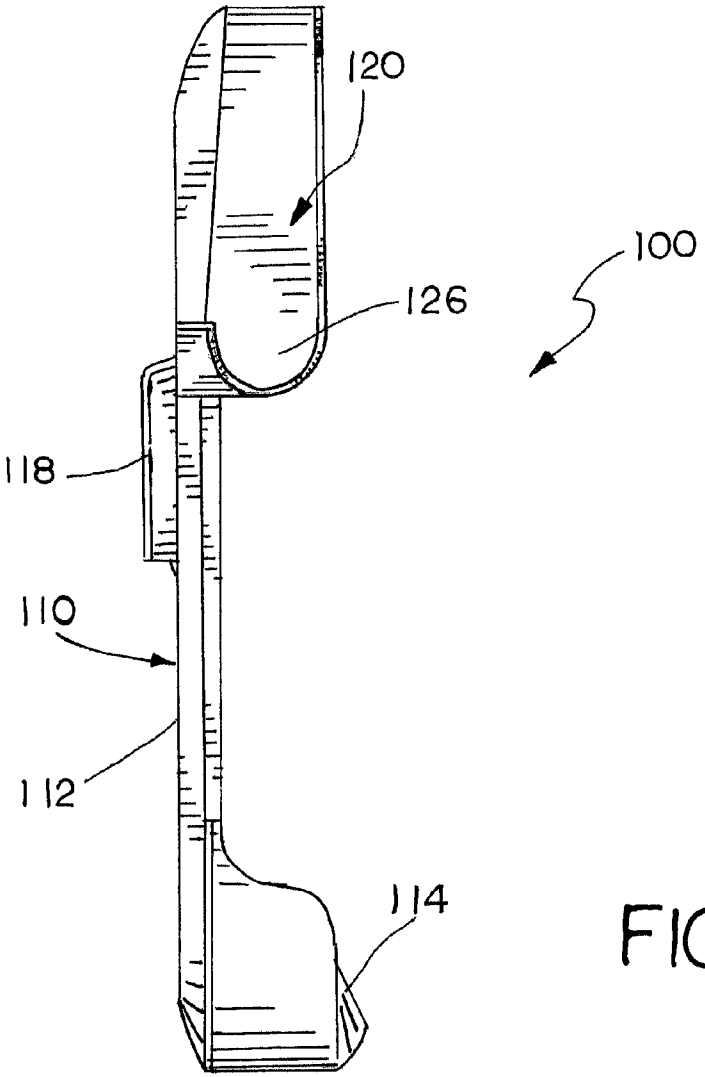
FIG. 5 is a left side view of the holster of FIG. 1.
Figure 6:
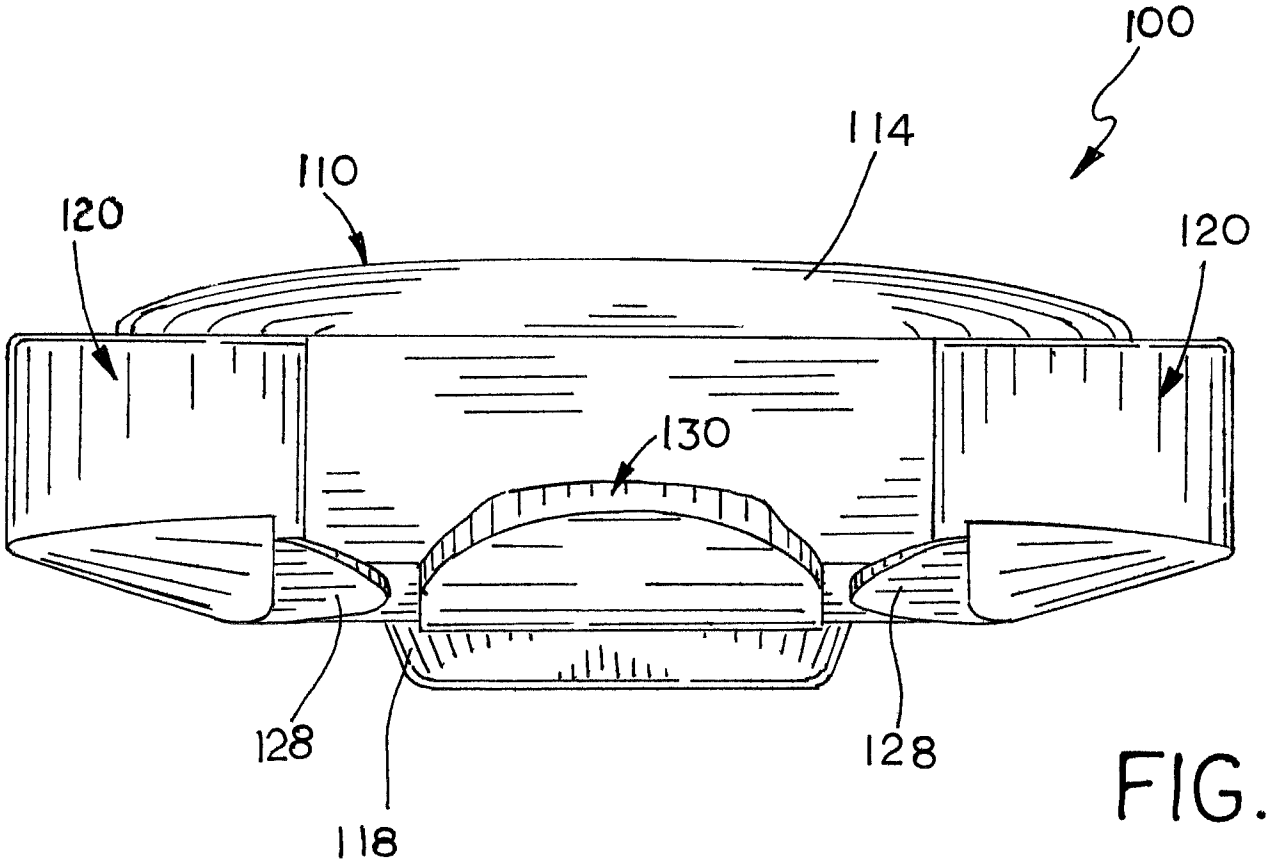
FIG. 6 is a top view of the holster of FIG. 1.
Figure 7:
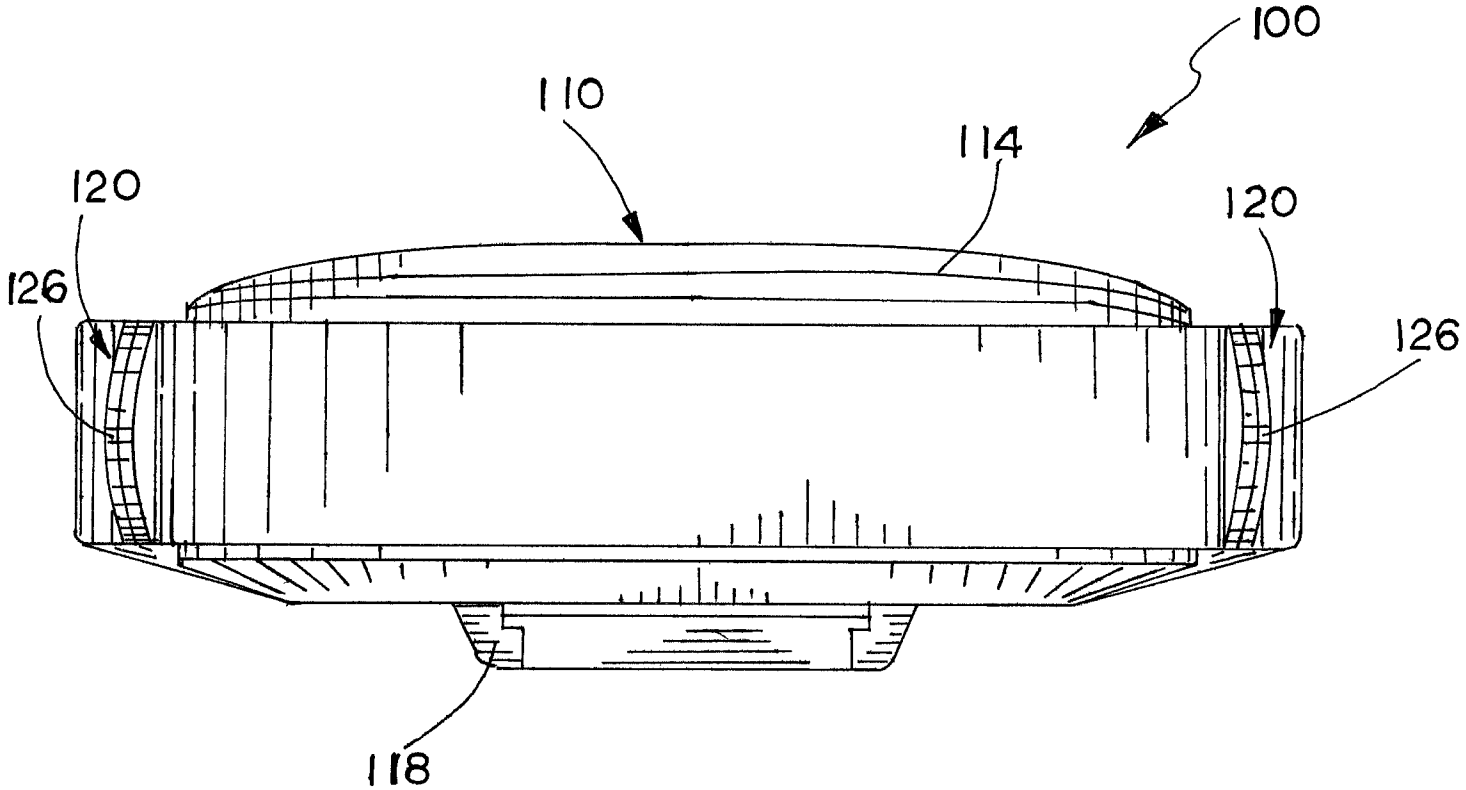
FIG. 7 is a bottom view of holster of FIG. 1.

In the following detailed description of the preferred embodiments, reference is made to the accompanying drawings that form a part hereof, and in which is shown by way of illustration, specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-10 illustrate an embodiment of the present invention where the holster is designated generally as reference numeral 100 in use with a handheld police radio 10. As shown, holster 100 is designed and intended for use with a particular police style handheld radio; however, the teaching of this invention may be adapted for use with any handheld radio or electronic device, including but not limited to cell phones, PDAs, GPS and recording devices, cameras and the like. As shown, radio 10 has a pair of recessed grooves 13 formed in the upper corners of the radio body 12.

Holster 100 is molded or otherwise constructed of a suitable plastic polymer material. The polymer construction affords the holster the necessary strength and durability for extended rugged use, but also provides the material resilence for its integrated release and locking mechanism. Holster 100 has a body with an open interior 111 and is dimensioned and configured to receive radio 10 therein. As shown, holster body 110 includes an integral flat back 112, a bottom cradle 114, a pair of retention ears 120 and a rear projection member 130. Bottom cradle 114 is shaped to receive and nest the bottom of radio 10 therein. The rear of the holster hack includes a molded attachment structure 118 for affixing conventional mounting hardware for donning the holster to a utility belt or similar item. Attachment structure 118 is configured to accept any variety of conventional mounting hardware within the teaching of this invention.

Figure 8:
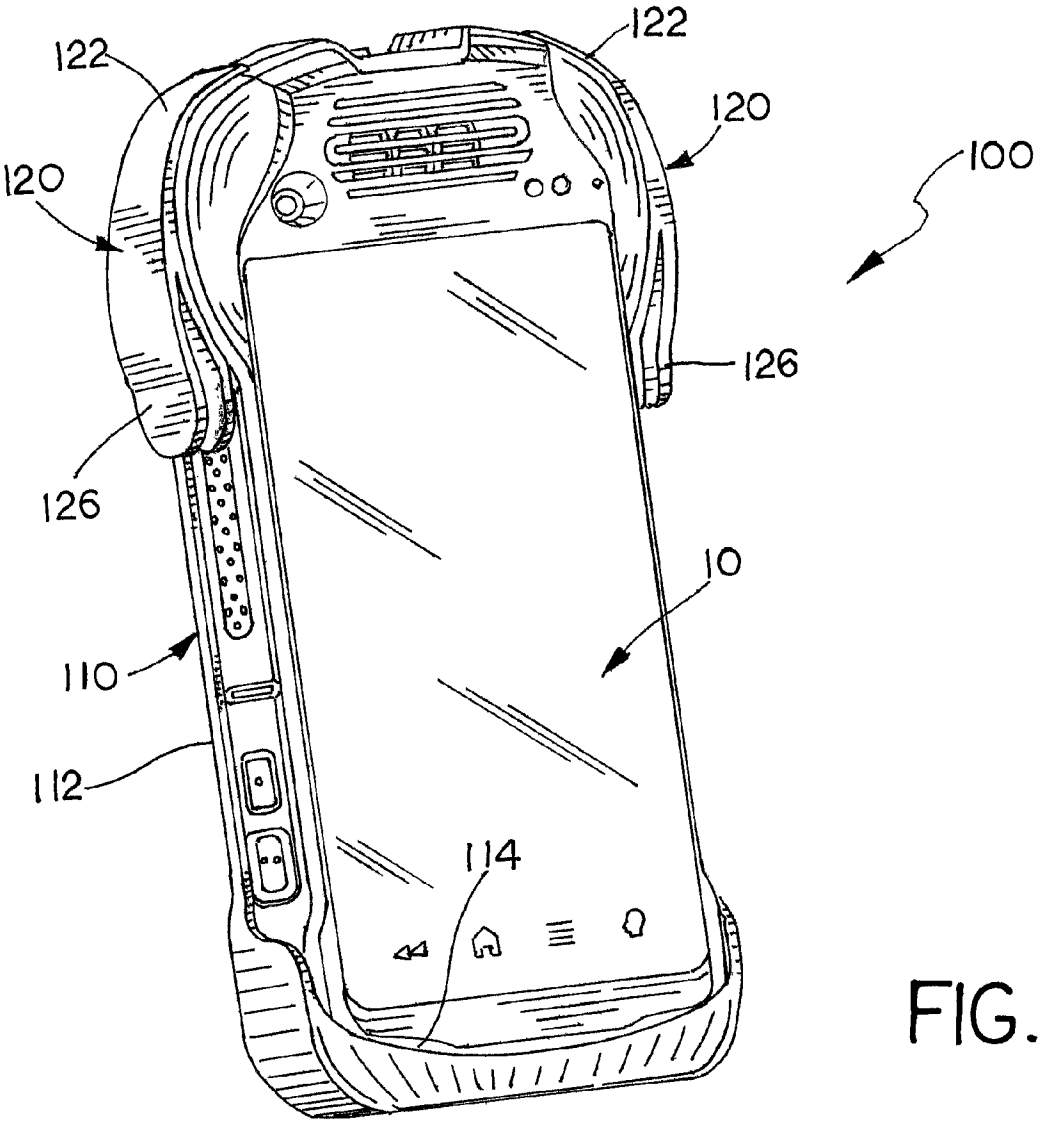
FIG. 8 is a front perspective view of the holster of FIG. 1 and a handheld radio fully seated within the holster.

Retention ears 120 are integrally formed as part of the holster body and extend from the upper corners of holster body 112. Retention ears 120 restrictively overlap the upper corner of radio 10 to securely hold the radio within holster interior 111 (FIG. 8). As shown, retention ears 120 have a rounded corner wall 122, which overlies the upper corners of radio 10. An elongated rib 124 protrudes inwardly from the inner face of each corner wall 122. When radio 10 is fully seated within holster 100, ribs 124 seat within grooves 13 of radio 10, which helps lock the radio within holster interior 111. Each retention ear 120 has a back lob 128, which over lies and supports the back of the radio 10 and integral lever arm 126 overlie and is spaced from corner wall 122. A pair of slots 127 and 129 are formed in retention ears between back lob 128, corner wall 122 and holster back 114, which allows corner wall 122 to act as a living hinge. Applying manual pressure inward against lever arms 126 urges the top portion of retention ears 120 radially outward away the top of radio so that ribs 124 are unseated from grooves 113 in radio 10, thereby allowing radio 10 to be freely un-holstered.

Figure 9:
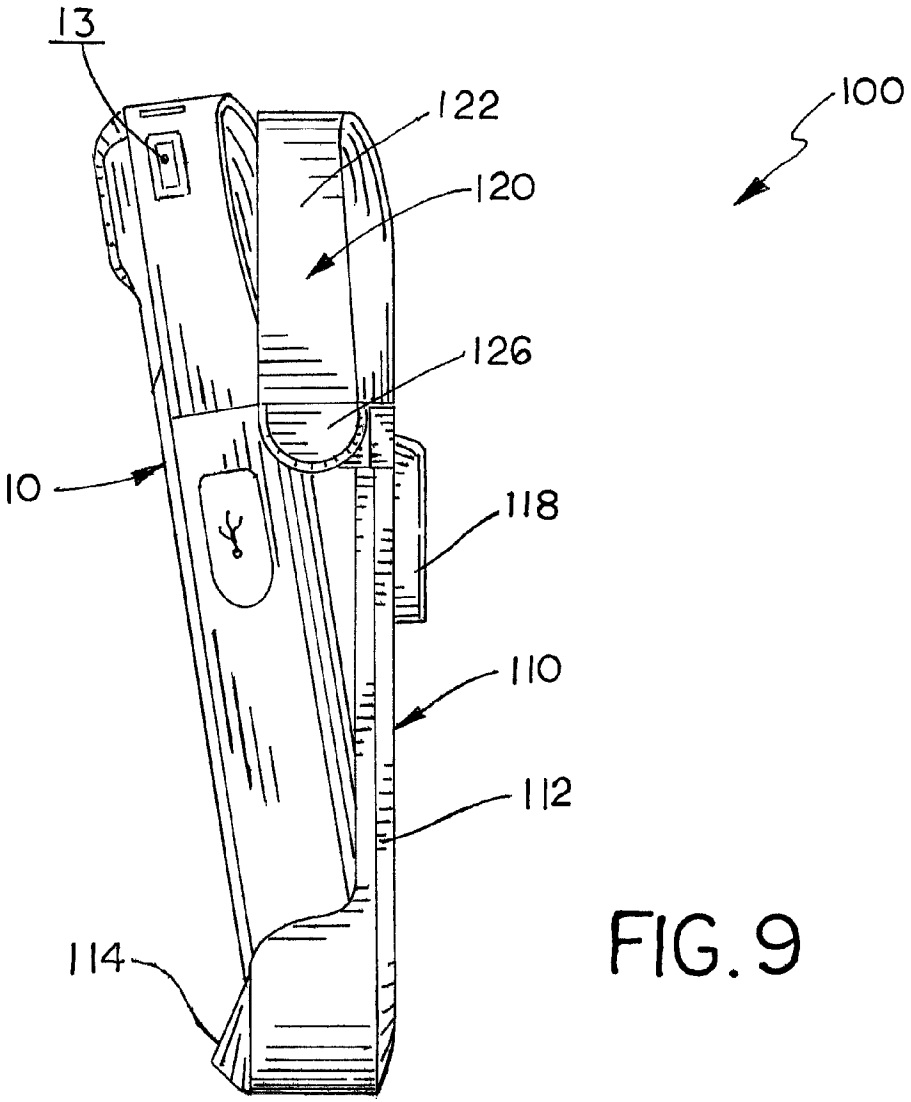
FIG. 9 is side view of the holster of FIG. 1 and the handheld radio partially seated within the holster.
Figure 10:
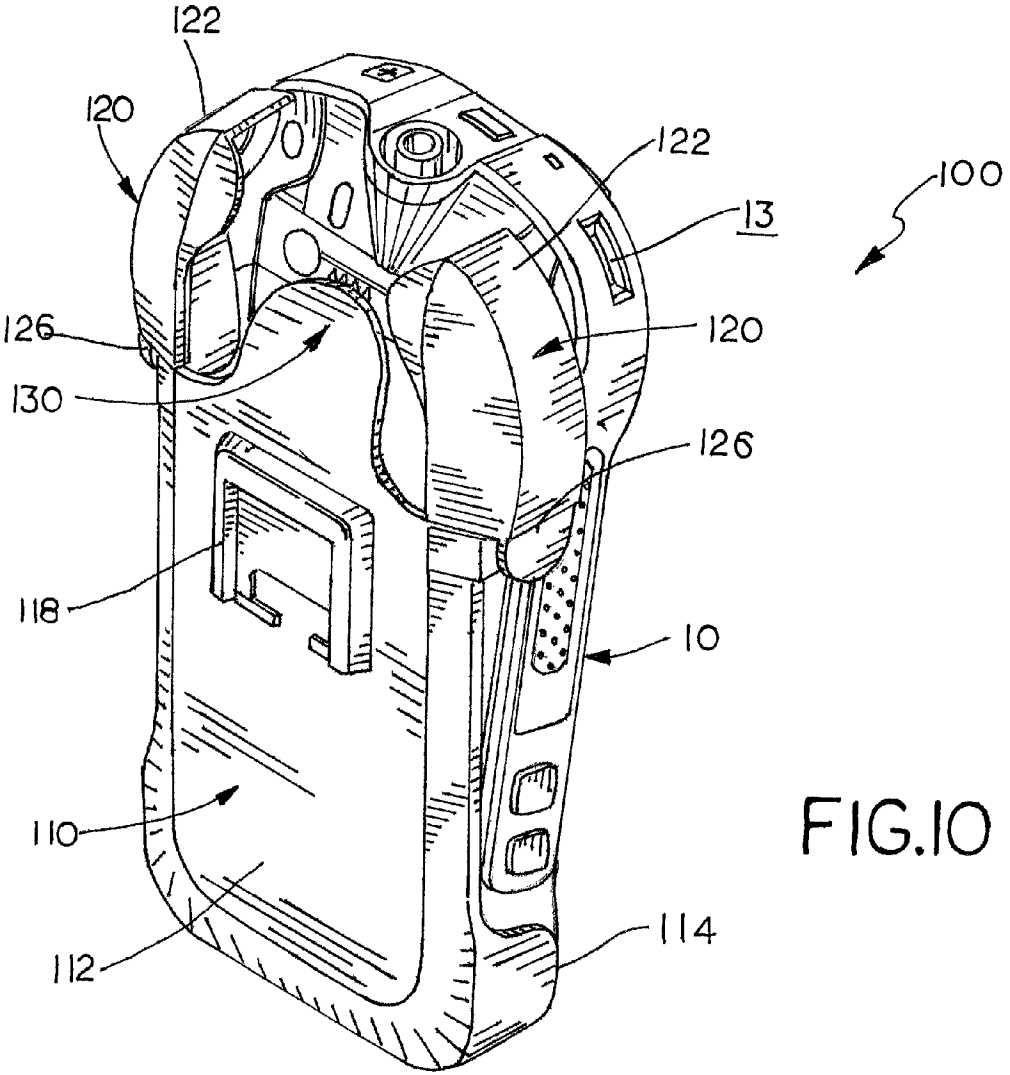
FIG. 10 is rear perspective view of the holster of FIG. 1 and the handheld radio partially seated within the holster.

Holster body 112 has an integral projection member 130 extending inward from holster back 114 into holster interior 111. Projection member 130 provides a slight outward spring force on radio 10, which allows the radio to be pushed forward from the holster interior 111 with the bottom of the radio still being retained within cradle 114 without "popping" out of holster 100 when retention ears 120 are retracted (FIGS. 9 and 10). Projection member 130 is pressed outward when radio is fully seated within holster interior 111 and urges radio 10 outward when retention ears 120 are retracted to release the radio.

Retention ears 120 and projection member 130 allow radio 10 to be inserted and removed from holster 100 with a single hand. In addition, the radio can also be inserted or removed using the same hand regardless as to where the holster is worn on user's body by simply changing the orientation of the user's hand. To insert radio into holster, the user grasping the radio in one hand simply seats the bottom of the radio within cradle 116 and push as the top of the radio back into holster interior 111 against the spring tension of projection member 130. Once pushed back against projection member 130, retention ears 120 "snap" over the upper corners of radio 10 seating ribs 124 into grooves 13 locking radio 10 securely within holster interior 111 (FIG. 8). It should be noted that radio 10 is held securely in holster 100 at one end by ribs 124 and at the opposite end by cradle 114. To remove radio 10 from holster 100, the user inwardly compresses lever arms 126 of retention ears 120 with the thumb and forefinger of one hand, which spreads the retention ears unseating ribs 124 from grooves 13. As soon as ribs 124 are unseated from grooves 13, projection member 130 urges radio forward out of holster interior 111 (FIGS. 9 and 10) into the palm of the user's hand.

Figure 11:
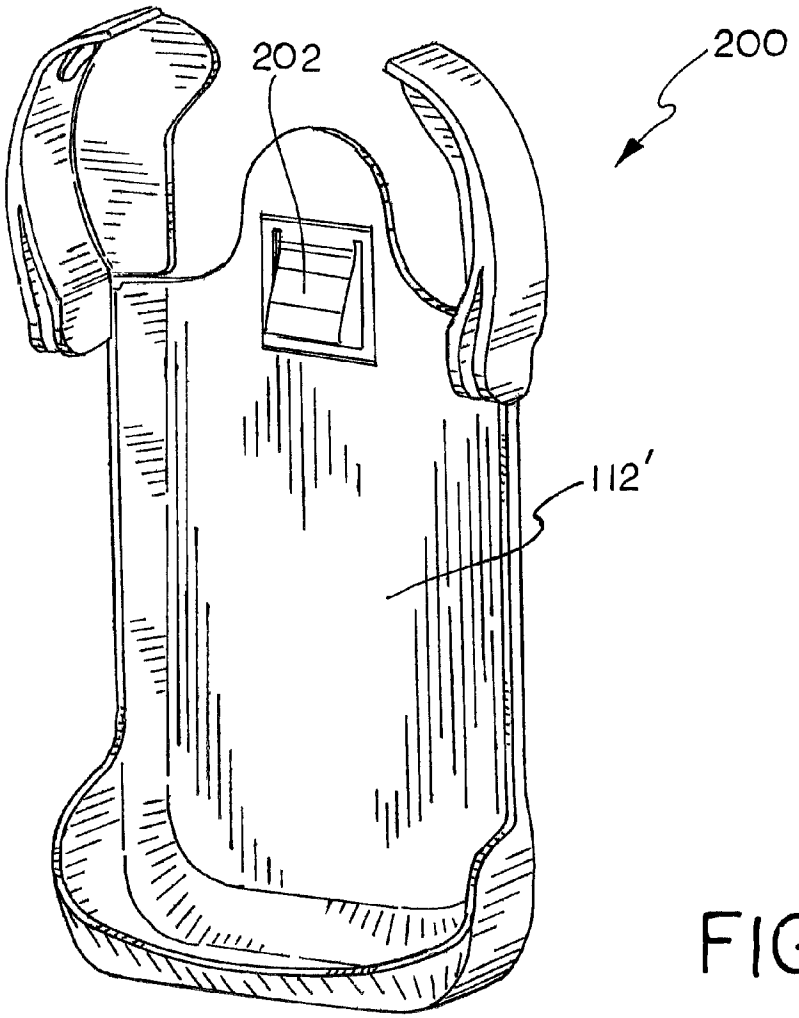
FIG. 11 is a front perspective view of a second embodiment of the holster of this invention.
Figure 12:
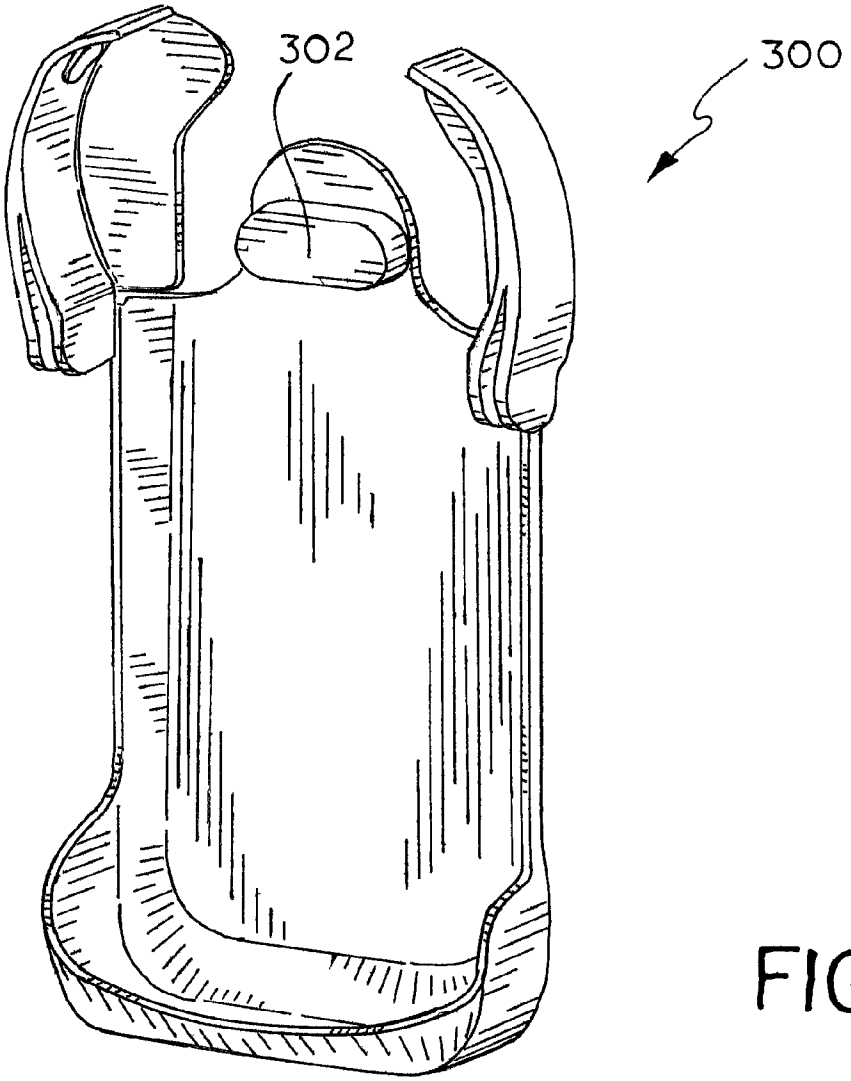
FIG. 12 is a front perspective view of a third embodiment of the holster of this invention.

FIGS. 11 and 12 show two additional holster embodiments of the present invention, designated as reference numeral 200 and 300. Both holsters 200 and 300 are similar to holster 100 in design and function. Holster 200 replaces projection member 130 of holster 10 with a separate leaf spring 202, which applies an outward force on the handheld device when fully seated within the holster. As shown, spring 202 may be constructed of metal and fixed to the inside of the holster back 112'. Similarly, holster 300 replaces projection member 130 of holster 100 with an elastic grommet 302 or similar structure, which provides the outward force on the handheld device.

One skilled in the art will note that the holster of this invention provides a holster that not only securely locks a handheld device, such as a radio or other electronic devices, within the holster body, but it allows the device to be readily inserted or removed with a single hand. The polymer construction of the holster body provides strength and durability, while enabling the living hinge design of the retention ears and spring force of the projection member. The retention ears hinge to securely lock the device in place and a projection member applies a small outward force on the device to urge it outward from the holster when the retention ears are manually disengaged. Moreover, the retention ears and projection members allow user to quickly and easily insert and remove the device from the holster using a single hand.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A holster for a handheld device, where the handheld device has a rectangular device body having adjacent upper corners, a peripheral edge thereof, and a groove formed in the peripheral edge at adjacent upper corners of the device body, the holster comprising:

a holster body defining an open interior thereof for receiving the handheld device therein, the holster body having a flat holster back, a cradle part integrally formed at one end of the holster back for receiving the bottom of the device, a projection member extending from the holster back opposite the cradle part for providing an outward force on the handheld device urging the handheld device away from the holster back when the handheld device is received within the holster body interior, and a pair of retention ears integrally ending from the holster back opposite the cradle part and spaced apart on opposite sides of the projection member for restrictively receiving opposite corners of the device the pair of retention ears each have a rib extending into the holster body interior for restrictively seating within the grooves of the handheld device to secure the handheld device within the holster body interior.

2. The holster of claim 1 wherein the pair of retention ears each includes a rounded corner wall configured to overlie the adjacent upper corners of the device body when the handheld device is received in the holster body open interior.

3. The holster of claim 1 wherein the rib of each of the pair of retention ears protrudes inwardly from the adjacent upper corners of the handheld device.

4. The holster of claim 1 wherein the pair of retention ears each includes a back lob adapted to overlie and support the handheld device.

5. The holster of claim 1 wherein the pair of retention ears each includes an integral lever arm overlying and spaced from the corner wall such that manual force exerted on the lever arms displaces the corner walls from the adjacent upper corners of the handheld device and retracts the ribs from the grooves of the handheld device.

6. The holster of claim 1 wherein the pair of retention ears each have a slot formed therein between back lob and corner wall, such that the corner wall acts as a living hinge.

* * * * *